United States Patent [19]

Laing

[11] 4,255,799

[45] Mar. 10, 1981

[54] UNDERWATER-TARGET DIRECTION-FINDING APPARATUS

[75] Inventor: Joseph T. Laing, Ellicott City, Md.

[73] Assignee: The United States of America as represented by the Secretary of the Navy, Washington, D.C.

[21] Appl. No.: 75,061

[22] Filed: Dec. 7, 1960

[51] Int. Cl.[3] ..... G01S 15/88; F42B 19/01

[52] U.S. Cl. ..... 367/96; 114/23

[58] Field of Search ..... 114/20, 21.1, 23; 340/1, 3, 6; 181/0.51; 367/96, 97

[56] References Cited

U.S. PATENT DOCUMENTS

| | | | |
|---|---|---|---|
| 2,431,854 | 12/1947 | Wood | 367/97 |
| 2,530,528 | 11/1950 | Kreer, Jr. | 367/125 |
| 2,743,438 | 4/1956 | Page | 367/90 |
| 2,961,190 | 11/1960 | Miller | 367/96 |
| 2,991,741 | 7/1961 | Chapin | 367/126 |
| 2,995,100 | 8/1961 | Edwards | 367/124 |
| 3,024,755 | 3/1962 | Brooks | 367/96 |

*Primary Examiner*—Richard A. Farley

*Attorney, Agent, or Firm*—Richard S. Sciascia; Ervin F. Johnston

EXEMPLARY CLAIM

1. In an underwater-target direction-finding apparatus of echo-ranging type, in combination: receiver means, including a network tunable to resonance at echo signal frequency, for deriving, from received echo signals, command signals carrying echo-source direction information; target-recognition means for providing a gating signal only upon and during reception of an echo signal arising from a true target, and in time-coincidence with that echo signal; utilization means controllable by and in response to said command signals when applied thereto; and circuit means for placing said network in resonant condition in response to and only during occurrence of said gating signal, whereby to limit control of said utilization means to command signals stemming from true target echo signals.

3 Claims, 3 Drawing Figures

UNDERWATER-TARGET DIRECTION-FINDING APPARATUS

The present invention relates generally to underwater-target detection systems of echo-ranging type, and more particularly to improved target-recognition gating, in such systems, which effects substantially instantaneous response to true target echoes.

The invention is directly intended for use in echo-ranging homing torpedoes of the type employing a target-recognition circuit for the purpose of effecting steering action in response only to true target echoes. Torpedoes of such type, having a target-recognition gating circuit and, a steering control circuit which can be responsive to steering command signals only when it is gated, conventionally employ relays exhibiting response delays which are ordinarily tolerated by the torpedo system, generally providing satisfactory homing action under conditions of normal target echoes. It has been found, however, that under certain conditions which may occur during target pursuit, giving rise to target echoes which are subnormal say as to effective pulse duration, or as to amplitude variations or other characteristic variations within the echo pulse, such a torpedo may execute faulty pursuit action, attributable to response delay in target-recognition gating with consequent reduction or even loss or perversion of target direction or torpedo-steering information to the steering control circuit. This will be better understood by considering a specific example of such a torpedo, for example that described in copending patent application Ser. No. 596,366 entitled "Torpedo Homing System", filed July 6, 1956 by D.A. Cooke, now U.S. Pat. No. 3,722,446 wherein a steering control circuit actuates steering apparatus in response to and in accordance with a steering command signal pulse supplied by the receiver apparatus of the torpedo, provided that the steering command signal pulse stems from a true target echo rather than from a spurious echo as in effect recognized or determined by a target-recognition circuit. Each echo reflected from a true target, as evidenced by an echo signal exceeding say a predetermined amplitude threshold, causes the gate circuit to operate an associated gating relay, in turn rendering the steering control circuit responsive to become responsive to the corresponding steering command signal pulse. In the above-described system, therefore, a steering command signal pulse cannot be effective to control torpedo steering unless and until the gating relay operates in response to a gating signal derived from a true target echo. The delay interposed by gating relay response time causes loss of response to the leading portion of the steering command signal pulse and, under the condition of a subnormal target echo which may occur during target pursuit as noted above, the remaining portion of the steering command signal pulse corresponding to that particular echo may be ineffective to provide proper steering information to the steering control circuit, thereby deteriorating the torpedo pursuit action.

A principal object of the present invention, accordingly, is to provide a novel combination of underwater target direction finding apparatus and target-recognition gating system which prevents reduction or loss of target direction information.

Another object of the invention is to provide an underwater target-recognition electronic gating circuit which responds substantially instantaneously to true target echoes.

Other objects and many of the attendant advantages of this invention will be readily appreciated as the same becomes better understood by reference to the following detailed description when considered in connection with the accompanying drawing wherein.

In accordance with the present invention as employed in an echo-ranging homing torpedo, improved homing action is provided by use of a novel combination, involving an electronic gating technique, which effects substantially instantaneous switching action to prevent reduction or loss of target direction or torpedo steering information carried by steering command signal pulses, as will appear from the following description.

Figure 1:
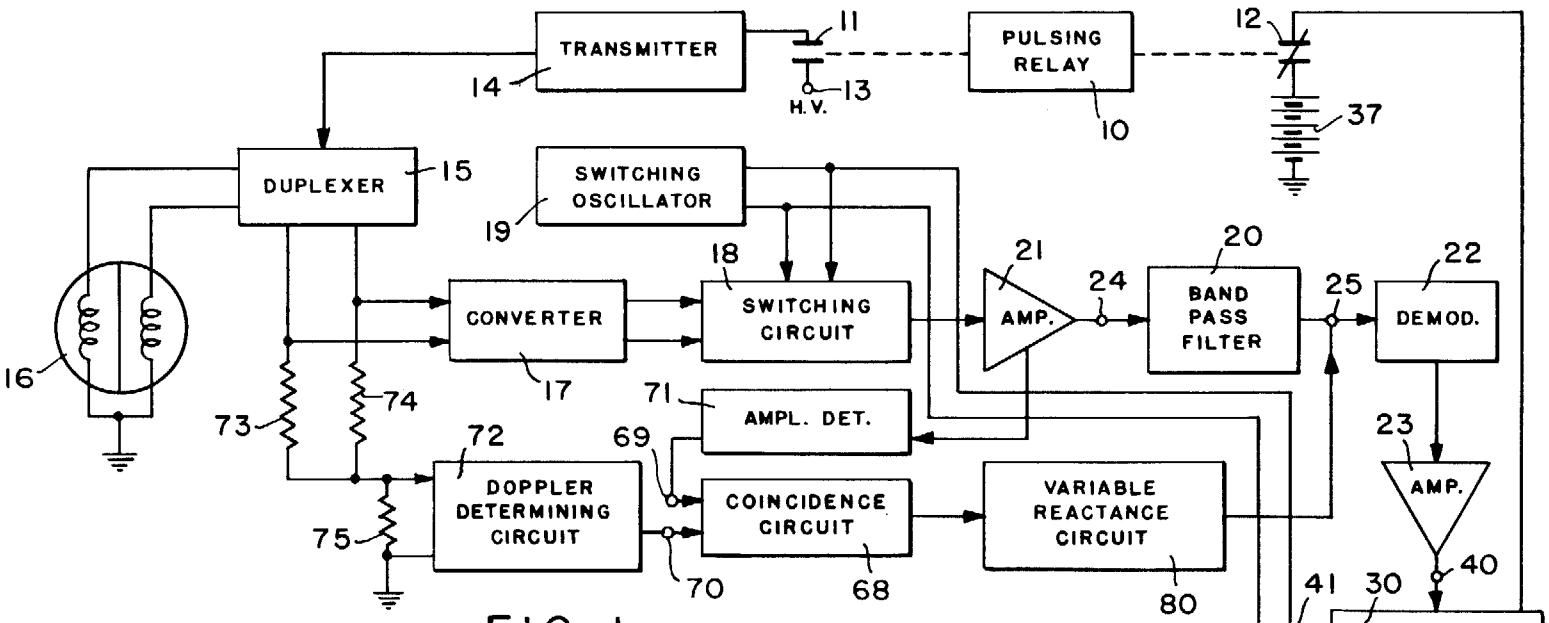
FIG. 1 is an exemplary embodiment of the present invention in a homing torpedo system shown in block diagram form.

Referring first to FIG. 1, the exemplary torpedo system there shown in block diagram form is basically of known type and circuitry except for the manner in which the target recognition circuit is employed to control application of steering command signal pulses. It will be understood that for purposes of simplification, and sufficing to impart a full understanding of the invention, the torpedo system as illustrated and described is limited to that which obtains during the pursuit phase of torpedo operation, and further limited to concern homing control in course only. Each of the block-represented units may be of conventional type. Pulsing relay 10, operated say by timing switch means to close relay contacts 11 (and to open relay contacts 12) for brief periods of say 40 milliseconds or less duration, and at intervals of say 1.25 seconds, causes the high voltage (H.V.) supplied to terminal 13 to be intermittently applied to transmitter 14, resulting in the generation and projection of search pulses. Duplexer 15 enables use of the transducer 16 both for transmission of search pulses and for reception of resultant echo pulses. Transducer 16 is provided with two sections, as indicated, which are excited in parallel during transmission, and which, during the listening period following transmission of a search pulse, receive reverberation and echoes and provide converter 17 with a pair of input signals which are equal in amplitude but differ in phase in accordance with echo source direction (relative to the transducer axis, not shown). Converter 17 operates at input signal frequency (say about 60 kilocycles per second), functioning to transform the pair of phase-differing input signals to a corresponding pair of amplitude-differing signals, still at input signal frequency. For the purpose of enabling employment of a single-channel multi-stage amplifier, the dual signal outputs of converter 17 are applied to switching circuit 18 which, under control of switching oscillator 19 (operating at say 1 kilocycle per second), provides a single-channel amplitude-modulated output signal, the carrier frequency being the same as the input signal frequency, and the modulation component being at switching oscillator frequency. The phase and amplitude characteristics of the modulation component correspond to the sense and magnitude, respectively, of the deviation of echo source direction relative to the torpedo.

In the illustrated embodiment the arrangement is such that, provided the target-recognition and electronic gating circuit, as later described, enables the band-pass filter 20 associated with multi-stage amplifier 21 to pass the modulated output signal pulse, demodulator 22 isolates the modulation component and delivers it as a steering command signal pulse to amplifier 23. Input terminal 24 of band-pass filter 20 connects to the last stage of amplifier 21; in the absence of a true target echo, the output of band-pass filter 20, at its terminal 25 which connects to demodulator 22, is normally held at substantially zero value by application of an effective shunting capacitance, as later described and for reasons which will appear.

When a steering command signal pulse of sufficient amplitude (corresponding to sufficient deviation of target direction relative to the transducer axis) is applied by amplifier 23 to the control circuit 30, to which are also supplied reference signals from switching oscillator 19 as indicated, control circuit 30 operates in response to the phase characteristic of the steering command signal pulse to energize a so-called steering relay which controls steering apparatus 31 as next described. It will be understood that each steering command signal pulse as applied to control circuit 30 is of brief duration corresponding to that of the received target echo from which the steering command signal pulse is derived.

Figure 2:
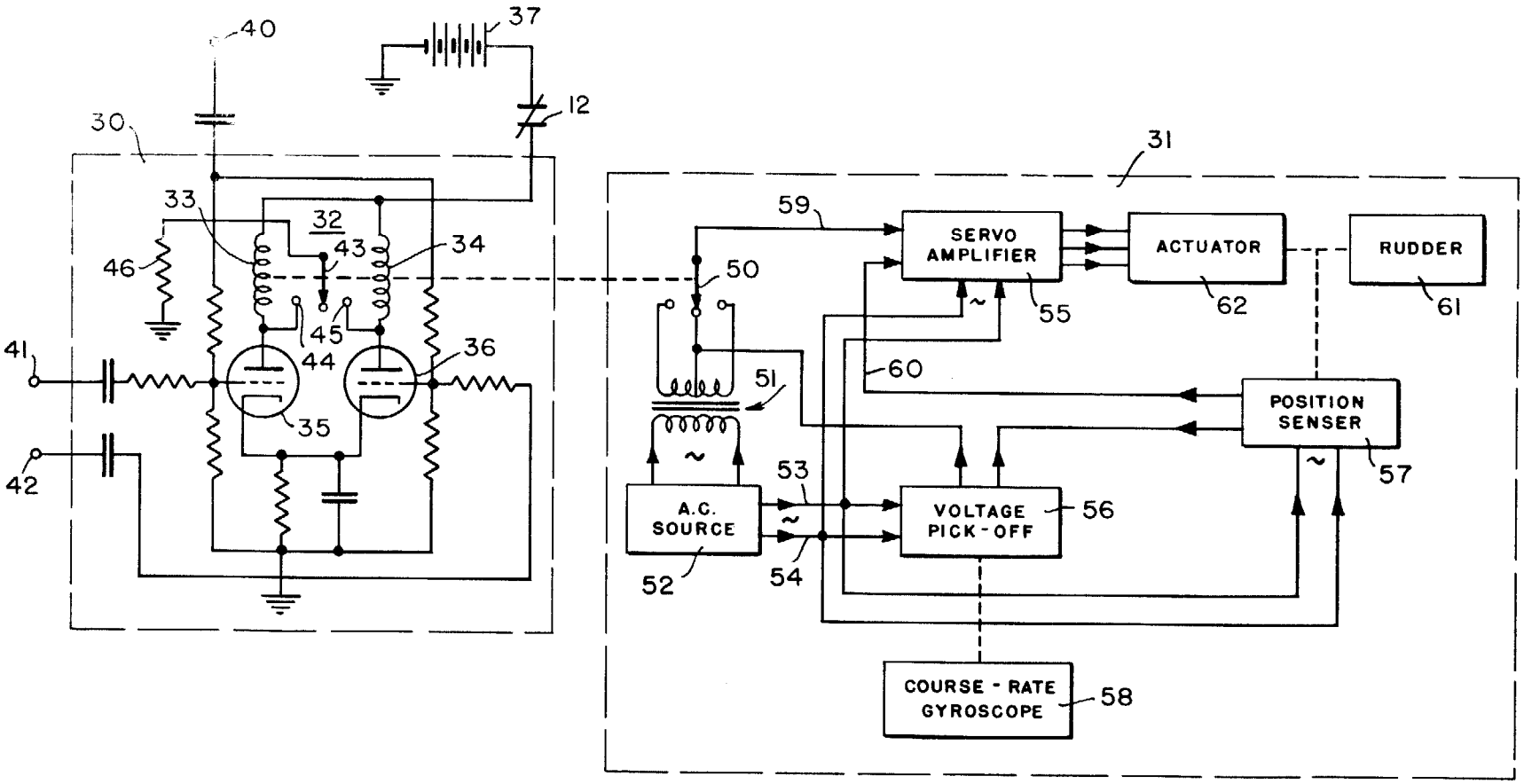
FIG. 2 is a schematic, partly in block diagram form, of steering control circuits and apparatus employed in the FIG. 1 homing torpedo system.

The manner in which the steering command signal pulse is utilized to accomplish torpedo steering will be understood by consideration of FIG. 2, illustrating an exemplary control circuit 30 and steering apparatus 31. Control circuit 30 may be of conventional phase-sensitive detector type, employing a three-position steering control relay 32 having its differential windings 33, 34 in the plate circuits of a pair of so-called steering-relay tubes 35, 36 as shown. Plate voltage is supplied from source 37 through normally-closed contact 12 during the listening period, and the tubes are suitably biased, say by cathode resistor means as shown, to limit the plate currents to satisfactory quiescent levels below that required for relay actuation. The amplified steering command signal pulse is applied to terminal 40, and oppositely-phased reference signals from switching oscillator 19 are continuously applied to terminals 41, 42. Depending upon the phase of the steering command signal pulse, corresponding to the sense of target direction relative to the transducer axis, swinger contact 43 will move into engagement either with contact 44 or 45, and will be maintained in such engagement until the end of the listening period, despite the pulse character of the steering command, by virtue of resistor 46 which completes a holding circuit. At the time when generation and projection of the next search pulse is initiated, pulsing relay 10 (FIG. 1) also functions to open contact 12, breaking the steering-relay energization circuit, so that swinger contact 43 is always in its neutral or mid-position at the beginning of each listening period. The remaining course-steering apparatus 31 is basically of conventional type, operated in accordance with a left- or right-steering control signal as applied through a phase-reversing switch 50 which is linked to swinger contact 43, as indicated. The control signal is obtained from the center-tapped secondary of transformer 51 which is energized by a.c. source 52. A.c. source 52 further serves to supply reference voltages via leads 53, 54 to servo-amplifier 55, voltage pick-off means 56, and rudder position-sensing means 57, and may also be employed to power servo-amplifier 55 and other units as required. The steering control signals, modified by summation with rudder-position and turn-rate signals delivered, respectively, by position senser 57 and by the voltage pick-off means 56 associated with course-rate gyroscope 58, as indicated, are applied via leads 59, 60 to the servo-amplifier 55. Servo-amplifier 55 thus correspondingly controls the torpedo course-steering rudder 61 through actuator 62 to steer the torpedo left or right, as in effect dictated by the steering command signal pulse and as required to intercept the echo source identified as a true target.

Referring again to the complete system illustrated in FIG. 1, and to the target recognition circuit therein as next described, the particular echo characteristics and likewise the specific circuits selected for true-target recognition purposes may be in accordance with any prior art practice. The target-recognition circuits in this instance are selected to require that both amplitude and target-doppler thresholds shall be exceeded by the echo signals. In the illustrated embodiment, a negative output pulse is generated by the coincidence circuit 68, provided that it receives, at its inputs terminals 69 and 70, a pair of pulses which are negative and in time coincidence. An amplitude-identifying negative pulse in time-coincidence with and corresponding to a received echo pulse, for application to terminal 69, may be derived by any conventional technique, and as here shown is obtained simply by means of an amplitude detector 71 which may receive its input signal from amplifier 21. Similarly, doppler determining circuit 72 may be of any conventional type such as employed in sonar and torpedo equipment designed for detection of moving targets, functioning to supply to terminal 70 a negative pulse which is of amplitude corresponding to the target-doppler frequency exhibited by the corresponding echo pulse from which it is derived, and which is in time-coincidence with that echo pulse. It will be understood that target-doppler frequency is the deviation of echo frequency relative to reverberation as received, varying in accordance with the target velocity component along the line of sight extending through the target. Echo signals received by both sections of transducer 16 may be combined and supplied to the doppler determining circuit 72 by means of the summation network comprising resistors 73, 74 and 75, as shown. Variable reactance circuit 80 likewise may be of any standard type and is here employed in a manner to normally shunt band-pass filter 20 with detuning capacitance, and to remove such capacitance in substantially instantaneous response to the coincidence circuit 68 negative output pulse which is generated as a result of and in time-coincidence with a true target echo.

Figure 3:
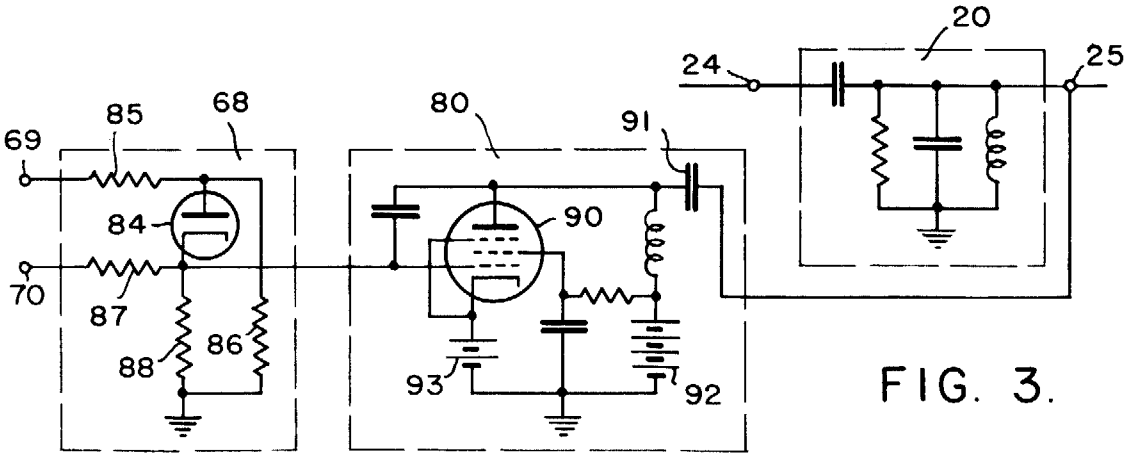
FIG. 3 is a circuit diagram of the target-recognition gating system as embodied in the homing torpedo system of FIG. 1.

Referring now to FIG. 3 for a better understanding of the electronic gating circuit, coincidence circuit 68 may comprise a diode 84 and resistors 85, 86, 87 and 88 in a circuit configuration as shown, wherein resistors 85 and 86 are small relative to resistors 87 and 88. By way of examples, resistors 85 and 86 may have values of the order of 0.1 and 0.4 megohms, respectively, as compared to values of the order of 4.0 and 10.0 megohms for resistors 87 and 88, respectively. In the variable reactance circuit 80, tube 90 may be employed in the illustrated reactance tube circuit which functions in well known manner to provide an effective output capacitance which is variable directly as the transconductance, inversely as the grid-to-cathode bias voltage, of tube 90. The grid bias path for tube 90 is in this instance completed by resistor 88 of the preceding coincidence circuit 68. Blocking capacitor 91, of comparatively large value relative to the maximum effective capacitance provided by the reactance tube, serves to isolate band-pass filter 20 from plate voltage source 92. The quiescent grid-to-cathode negative bias of reactance tube 90, as provided say by a voltage source 93, is of suitably low value to cause the output capacitance of circuit 80 to normally be held at its maximum value, detuning the band-pass filter 20 from its designed center-frequency.

In the absence of a true target echo, or upon reception simply of a spurious signal which does not meet target-recognition conditions, no negative pulse is developed by coincidence circuit 68, the grid-to-cathode bias of tube 90 remains at its low quiescent value, and band-pass filter 20 correspondingly remains shunted by a comparatively large value of effective capacitance. Under such condition, there is either zero output to demodulator 22 (FIG. 1), or a spurious output of insufficient magnitude to result in the development of a steering command signal pulse.

When the coincidence circuit 68 delivers a negative pulse in recognition of a true target echo, however, the grid-to-cathode bias of tube 90 becomes strongly negative and, correspondingly, the large shunting capacitance formerly imposed by variable reactance circuit 80 upon the band-pass filter 20 is in effect removed. Demodulator 22 then receives the amplitude-modulated signal pulse, passed by amplifier 21 and band-pass filter 20, from which it isolates the necessary steering command signal pulse for amplification and application to control circuit 30. Such action is substantially instantaneous, so that the steering command signal is supplied and utilized without loss of its leading portion as has occurred heretofore with conventional target-recognition gating systems.

The exemplary torpedo system, embodying the invention, as illustrated and described is of a type operating simply in a pursuit phase. It should be understood, however, that the novel electronic gating combination, in other torpedo systems, may be auxiliary to the conventional technique of gating by relay means retained to provide such additional functions as switchover from an initial phase to the pursuit phase upon target acquisition. It should further be understood that the invention may employ techniques other than the provision of shunting capacitance by a variable reactance circuit, that it is also applicable in principle to torpedo systems having circuitry other than that which has been illustrated and described, and to underwater target detection and direction finding equipment in general.

Obviously many modifications and variations of the present invention are possible in the light of the above teachings. It is therefore to be understood that within the scope of the appended claims the invention may be practiced otherwise than as specifically described.

What is claimed is:

1. In an underwater-target direction-finding apparatus of echo-ranging type, in combination: receiver means, including a network tunable to resonance at echo signal frequency, for deriving, from received echo signals, command signals carrying echo-source direction information; target-recognition means for providing a gating signal only upon and during reception of an echo signal arising from a true target, and in time-coincidence with that echo signal; utilization means controllable by and in response to said command signals when applied thereto; and circuit means for placing said network in resonant condition in response to and only during occurrence of said gating signal, whereby to limit control of said utilization means to command signals stemming from true target echo signals.

2. In an underwater-target direction-finding apparatus of echo-ranging type, in combination: receiver means including a conversion channel for deriving, from received echo signals, command signals carrying echo-source direction information; target-recognition means for providing a gating signal only upon reception of an echo signal arising from a true target, and in time-coincidence with that echo signal; utilization means controllable by and in response to said command signals when applied thereto; said conversion channel including a filter network and an auxiliary impedance, said filter network being normally detuned by said auxiliary impedance to reduce command signals arising from spurious echo signals to ineffective magnitude; and means responsive to said gating signal to effect removal of said auxiliary impedance, and thereby to enable control of said utilization means by command signals derived from true target echoes.

3. In a homing torpedo of echo-ranging type, in combination: receiver means having a conversion channel for deriving, from received echo signals, a modulated carrier signal wherein the modulation component carries echo-source direction information, said conversion channel including a band-pass filter designed to accommodate the frequency range of said modulated carrier signal, and a demodulator to isolate said modulation component from the modulated carrier signal; utilization means controllable by said isolated modulation component and in accordance with the echo-source direction information carried thereby; a variable reactance circuit, normally applying effective capacitance to said band-pass filter and reducing the modulated carrier signal applied to said demodulator to an ineffective value, and responsive to a gating signal to effect removal of said effective capacitance; and target-recognition means for providing said gating signal only upon reception of an echo signal arising from a true target, and in time coincidence with that echo signal, thereby to enable control of said utilization means only by isolated modulation components derived from true target choes.

* * * * *